US010677504B2

(12) United States Patent
Kim

(10) Patent No.: US 10,677,504 B2
(45) Date of Patent: Jun. 9, 2020

(54) EVAPORATOR FOR ICE MAKER

(71) Applicant: DAEYEONG E&B Co., Ltd., Ansan-si, Gyeonggi-do (KR)

(72) Inventor: Doo Ha Kim, Incheon (KR)

(73) Assignee: DAEYEONG E&B CO., LTD., Ansan-si (KR)

( * ) Notice: Subject to any disclaimer, the term of this patent is extended or adjusted under 35 U.S.C. 154(b) by 41 days.

(21) Appl. No.: 15/954,396

(22) Filed: Apr. 16, 2018

(65) Prior Publication Data

US 2019/0242633 A1 Aug. 8, 2019

(30) Foreign Application Priority Data

Feb. 2, 2018 (KR) ..... 10-2018-0013507

(51) Int. Cl.

| | |
|---|---|
| ***F25C 1/12*** | (2006.01) |
| ***F25B 39/00*** | (2006.01) |
| ***F25B 39/02*** | (2006.01) |
| ***F28D 1/047*** | (2006.01) |

(52) U.S. Cl.

CPC ..... *F25C 1/12* (2013.01); *F25B 39/00* (2013.01); *F25B 39/02* (2013.01); *F28D 1/0471* (2013.01); *F25B 39/022* (2013.01); *F25C 2500/02* (2013.01)

(58) Field of Classification Search

CPC .. F25C 1/12; F25C 1/142; F25C 1/145; F25B 39/022

See application file for complete search history.

(56) References Cited

U.S. PATENT DOCUMENTS

| | | | | |
|---|---|---|---|---|
| 2011/0094252 | A1* | 4/2011 | Yamaguchi | F25C 1/12 62/344 |
| 2014/0138065 | A1 | 5/2014 | Hotti et al. | |
| 2017/0067678 | A1* | 3/2017 | Melton | F25B 39/022 |

FOREIGN PATENT DOCUMENTS

| | | | |
|---|---|---|---|
| JP | 8-159625 | A | 6/1996 |
| JP | 2005-55446 | A | 3/2005 |
| JP | 2006-78157 | A | 3/2006 |
| JP | 2006-90691 | A | 4/2006 |
| JP | 2007-155298 | A | 6/2007 |
| JP | 2009-127911 | A | 6/2009 |
| JP | 2009-264729 | A | 11/2009 |
| JP | 2010-190450 | A | 9/2010 |
| JP | 2011-38706 | A | 2/2011 |

(Continued)

OTHER PUBLICATIONS

Office Action of corresponding Korean Patent Application No. 10-2018-0013507—8 pages, (Jun. 29, 2018).

(Continued)

*Primary Examiner* — Elizabeth J Martin

(74) *Attorney, Agent, or Firm* — Knobbe Martens Olson & Bear LLP

(57) ABSTRACT

Disclosed is an evaporator for an ice maker including: a refrigerant pipe having a circular cross-section, with refrigerant flowing therethrough; and a pair of ice making plates disposed on opposite sides of the refrigerant pipe. The refrigerant pipe is disposed between inner side surfaces of the ice making plates facing each other, and rounded parts are provided by being formed outwards at a place where the refrigerant pipe is located such that the rounded parts cover both sides of the refrigerant pipe by being in close contact therewith.

9 Claims, 5 Drawing Sheets

(56) References Cited

FOREIGN PATENT DOCUMENTS

| | | | |
|---|---|---|---|
| JP | 2011-75232 | A | 4/2011 |
| KR | 10-1335953 | B1 | 12/2013 |

OTHER PUBLICATIONS

Notice of Allowance of corresponding Korean Patent Application No. 10-2018-0013507—3 pages (Dec. 28, 2018).

* cited by examiner

<A – A>

<B – B>

<C – C>

EVAPORATOR FOR ICE MAKER

CROSS REFERENCE TO RELATED APPLICATION

The present application claims priority of Korean Patent Application No. 10-2018-0013507 filed on Feb. 2, 2018, the entire contents of which is incorporated herein for all purposes by this reference.

BACKGROUND

Field

The present disclosure relates to an evaporator for an ice maker.

Description of the Related Art

Generally, a flow down type ice maker is configured to produce ice by forcing ice making water to flow onto an ice making plate cooled by an evaporator, and to store produced ice in an ice storage bin through separation and falling of the ice from the ice making plate.

The foregoing is intended merely to aid in the understanding of the background of the present invention, and is not intended to mean that the present invention falls within the purview of the related art that is already known to those skilled in the art.

SUMMARY

One aspect of the invention provides an evaporator for an ice maker that is able not only to maintain a cross-section of a refrigerant pipe in a circular shape but also to maximize heat exchange efficiency and ice separating efficiency of the evaporator with a pair of ice making plates being configured to be bent to cover opposite sides of a refrigerant pipe.

Another aspect of the invention provides an evaporator for an ice maker that enables a refrigerant pipe having a circular cross-section to secure maximum efficiency of heat exchange with ice making plates without requiring a compression process for the refrigerant pipe.

Still another aspect of the present invention provides an evaporator for an ice maker including: a refrigerant pipe having a circular cross-section, with refrigerant flowing therethrough; and a pair of ice making plates disposed on opposite sides of the refrigerant pipe, wherein the refrigerant pipe is disposed between inner side surfaces of the ice making plates facing each other, and rounded parts are provided by being formed outwards at a place where the refrigerant pipe is located such that the rounded parts cover both sides of the refrigerant pipe by being in close contact therewith.

The ice making plates includes: flat parts provided and extending in areas excluding the rounded parts; and bent parts provided and formed to extend inclinedly inward from the flat parts on remaining areas excluding the rounded parts and the flat parts, and extending to the rounded parts.

An angle of the bent parts that are formed from the flat parts is an acute angle.

The bent parts extend to the rounded parts.

Ice frozen on the ice making plates is provided to fall along the rounded parts in an ice separating process.

A plurality of partitioning parts are provided on the ice making plates to allow an ice producing area to be disposed along a lengthwise direction of the refrigerant pipe by compartmentalizing outer side surfaces of the ice making plates; and the bent parts are configured to be separated at a regular distance from adjacent partitioning parts.

At the places the bent parts and the partitioning parts are separated, the flat parts extend to the rounded parts.

The flat parts of the ice making plates different from and located at places parallel to each other are configured to be separated at a regular distance from each other.

End parts of the rounded parts of the ice making plates different from and located at places parallel to each other are configured to be separated at a regular distance from each other.

A distance between the flat parts of the ice making plates different from and located at places parallel to each other is longer than a distance between the end parts of the rounded parts of the ice making plates different from each other, and is shorter than a distance between centers of the rounded parts of the ice making plates different from each other.

The refrigerant pipe is composed of: a plurality of straight line parts each extending in a straight line along a lengthwise direction of the refrigerant pipe and disposed in parallel to a direction perpendicular to the lengthwise direction; and communicating parts communicating end parts of adjacent different straight line parts with each other to allow the refrigerant to flow in zigzags, and the ice making plates are configured to cover the straight line parts of the refrigerant pipe.

The rounded parts each are configured to cover the refrigerant pipe by being in close contact with both sides of the straight line parts of the refrigerant pipe, and a flat part connecting a pair of rounded parts among the flat parts is provided thereon with a ridge protruding outwards.

The ridge has a triangle shape wherein a width of a cross-section thereof becomes gradually narrowed as the cross-section approaches outwards.

According to the evaporator for the ice maker composed of the above-described structure, heat exchange efficiency and ice separating efficiency of the evaporator can be maximally secured while the cross-section of the refrigerant pipe is maintained in a circular shape by allowing the ice making plates to exchange heat with the refrigerant pipe, due to the ice making plates being bent.

In addition, as the compression process for the refrigerant pipe is omitted, the heat transfer efficiency or the ice separating efficiency can be prevented from being decreased due to damage phenomenon occurring in the compression process for the refrigerant pipe.

In addition, as the cross-section of the refrigerant pipe is circular-shaped, even if the internal pressure of the refrigerant pipe rises steeply, the heat exchange area with the ice making plates is not reduced, whereby maximum heat transfer efficiency can be secured and use of a refrigerant having a relatively high pressure becomes possible.

BRIEF DESCRIPTION OF THE DRAWINGS

The above and other aspects, features and other advantages of the present invention will be more clearly understood from the following detailed description when taken in conjunction with the accompanying drawings, in which.

DETAILED DESCRIPTION

Figure 1:
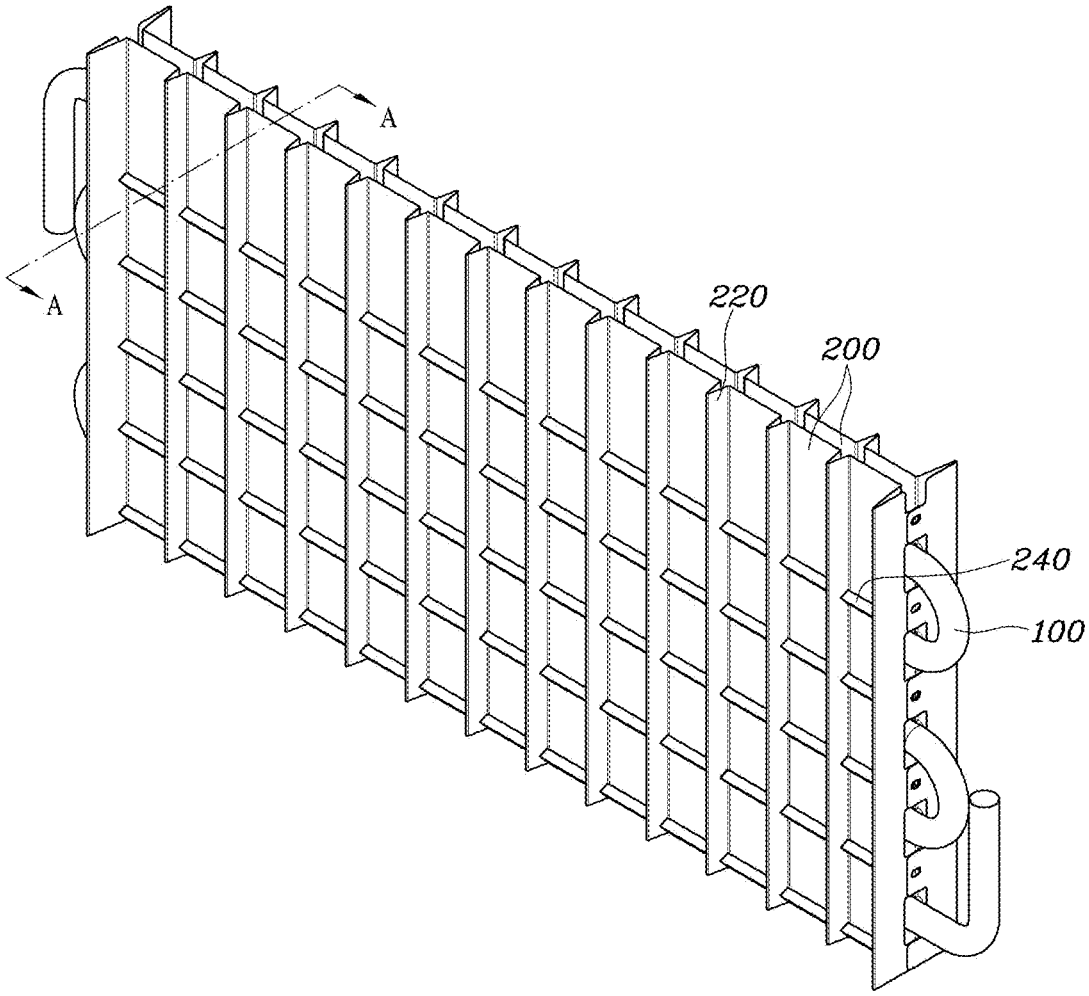
FIG. 1 is a perspective view illustrating an evaporator assembly according to a related art.

Hereinbelow, an evaporator for an ice maker according to embodiments of the present invention are discussed in detail with reference to the accompanying drawings. Throughout the drawings, the same reference numerals will refer to the same or like parts.

Figure 2:
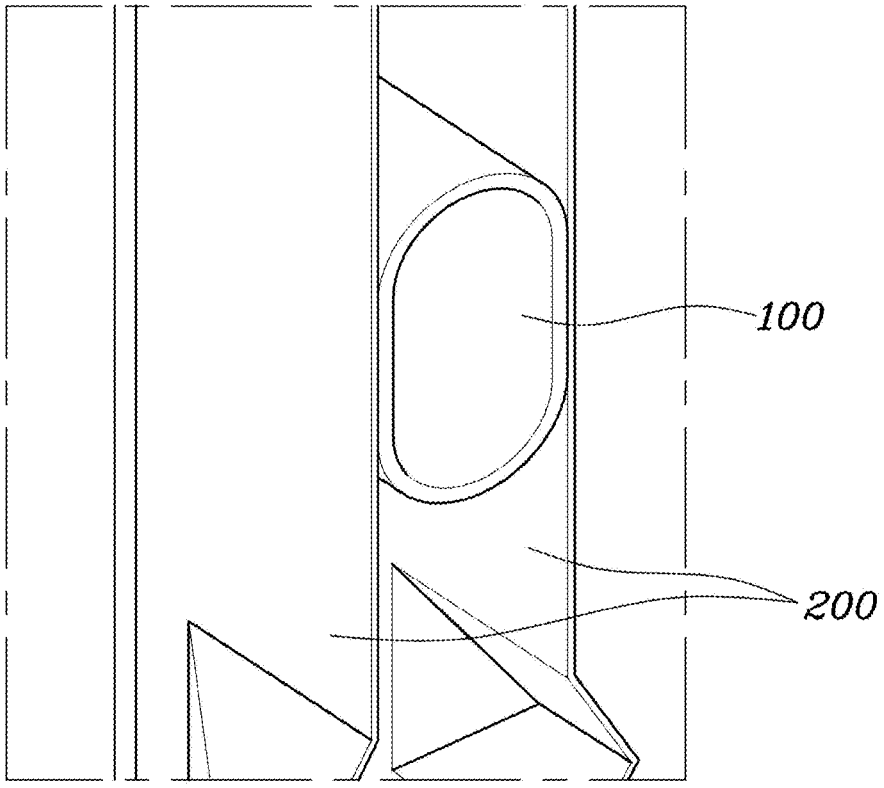
FIG. 2 is a perspective view illustrating a cross-section of FIG. 1 taken along line A-A.

FIG. 1 is a perspective view illustrating a typical evaporator assembly, and FIG. 2 is a perspective view illustrating a cross-sectional view of FIG. 1 taken along the line A-A.

Referring to FIG. 1, an evaporator for an ice maker is provided with a plural number of ice making plates 200 that are configured in an upright position, and a pipe 100 in which refrigerant flows is provided between the ice making plates 200 to come into contact therewith. In addition, a plurality of partitions 220, compartmentalizing the ice making plates 200 widthwise to produce a plurality of ice pieces, and ridges 240 are provided.

As illustrated in FIG. 2, the pipe 100 of the typical evaporator is compressed to be elliptical so that it is in contact with and exchanges heat with the ice making plates 200. That is, an elliptical type pipe 100 is manufactured by performing a process to compress a cylindrical pipe 100.

Here, the ice making plates 200 are provided to cover the pipe 100 of the evaporator which is extended in zigzags, excluding a place where the pipe 100 is bent as illustrated in FIG. 1.

Due to this, the pipe compression process is performed only for parts where the pipe 100 is extended in a straight line. Accordingly, in this process, hollow parts are generated at places between the straight line parts and the rounded parts by repelling power to maintain an original shape, whereby heat transfer efficiency decreases as the pipe 100 is separated from close contact with the ice making plates 200, thereby generating phenomenon that ice making capacity decreases. This is a major factor causing a decline in ice quality.

Figure 3:
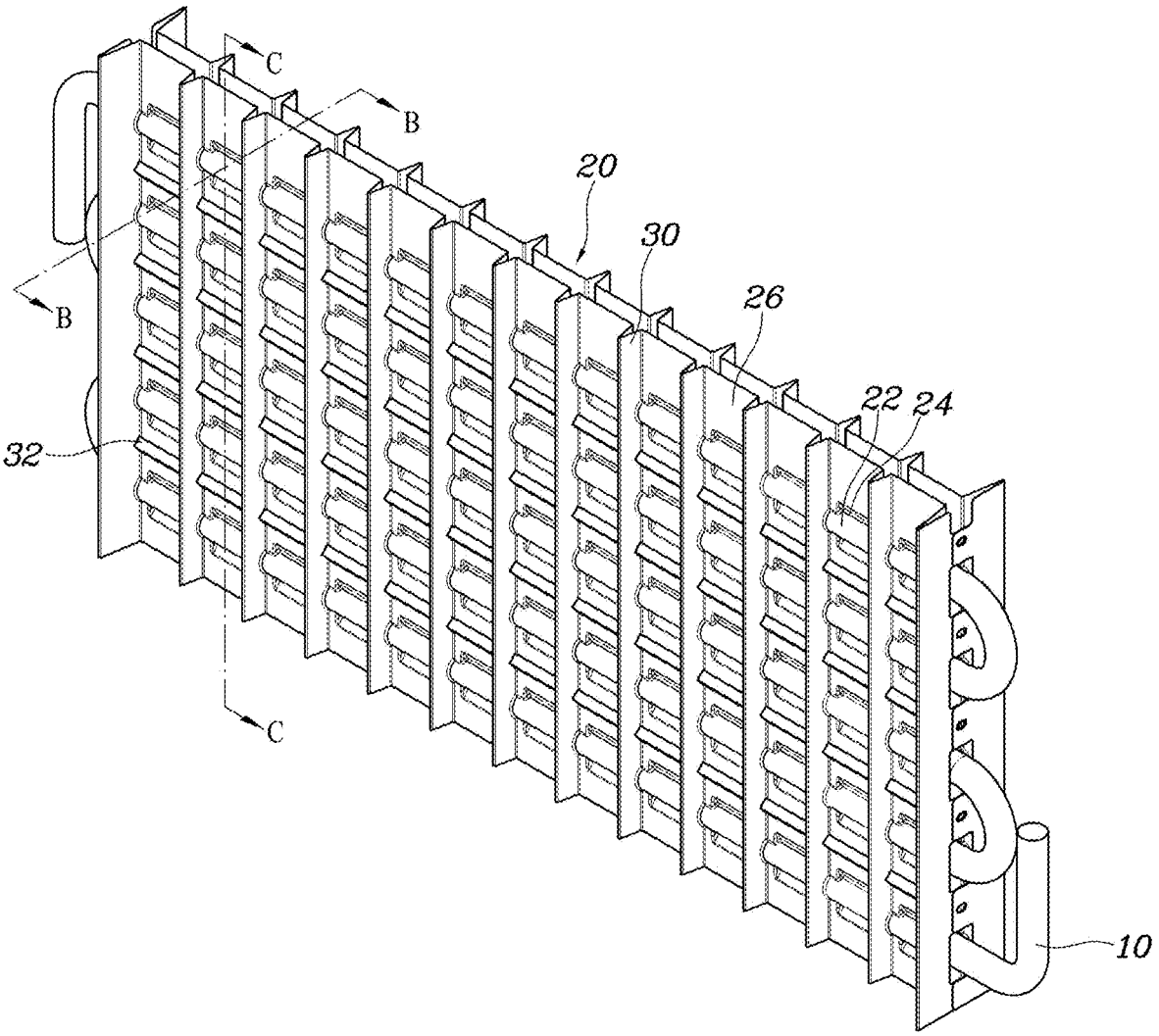
FIG. 3 is a perspective view illustrating an evaporator for an ice maker according to an embodiment of the present invention.
Figure 4:
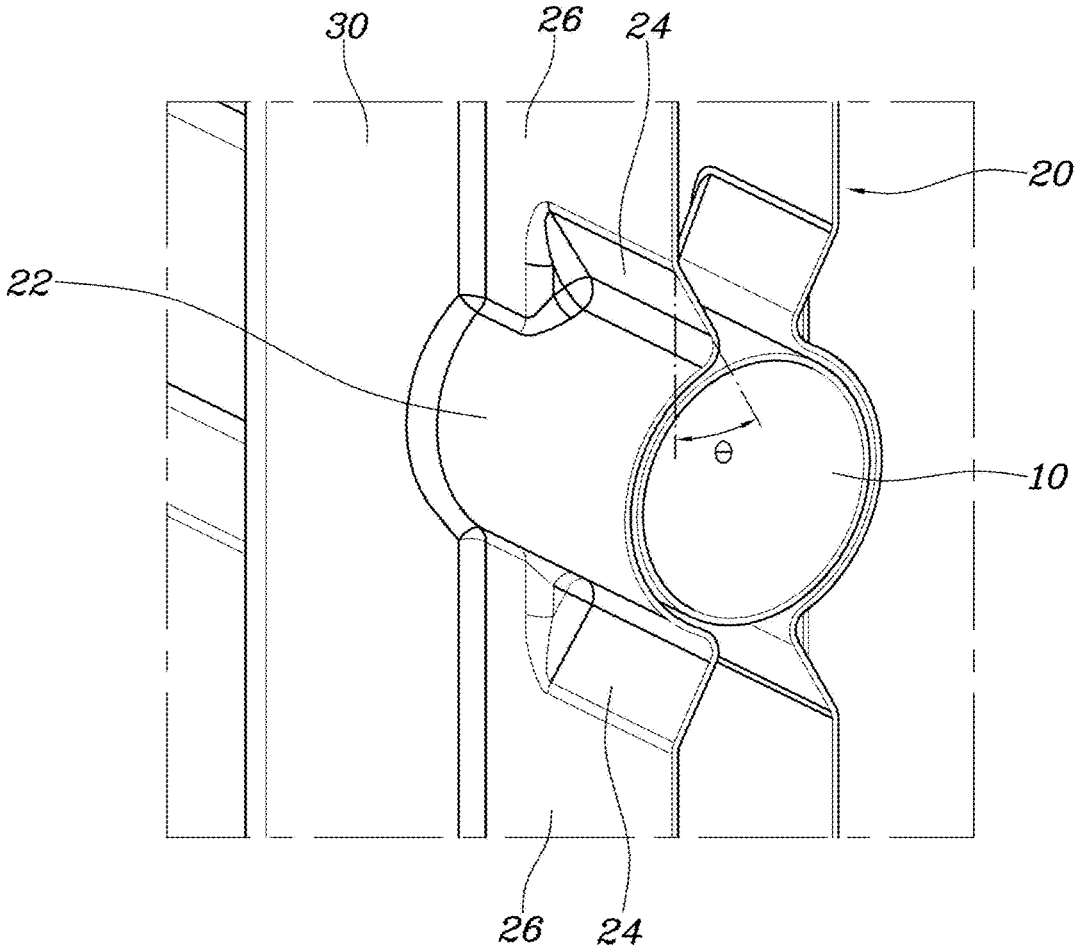
FIG. 4 is a perspective view illustrating a cross-section of FIG. 3 taken along line B-B.
Figure 5:
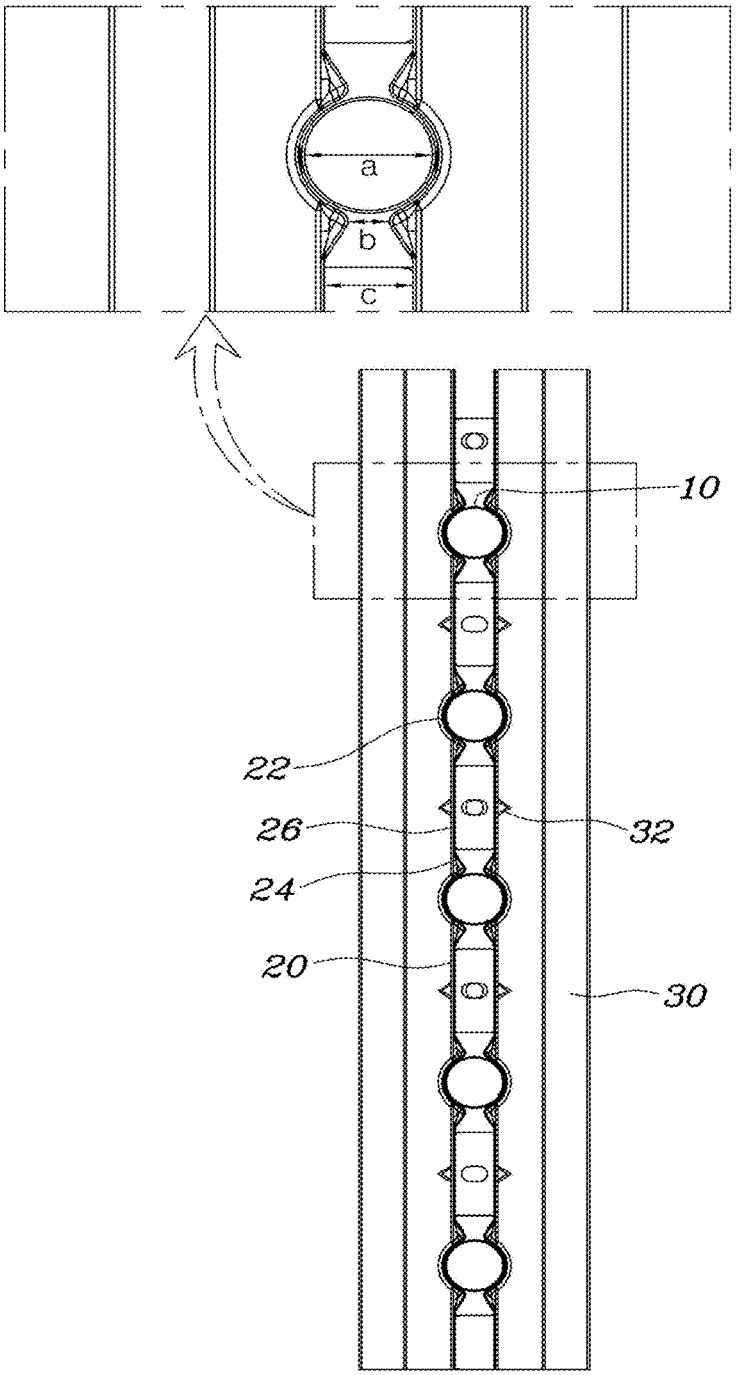
FIG. 5 is a cross-sectional diagram illustrating a cross-section of FIG. 3 taken along line C-C.

FIG. 3 is a perspective view illustrating an evaporator for an ice maker according to an embodiment of the present invention, FIG. 4 is a perspective view illustrating a cross-section of FIG. 3 taken along line B-B, and FIG. 5 is a cross-sectional diagram illustrating a cross-section of FIG. 3 taken along line C-C.

First, referring to FIG. 3, the evaporator for the ice maker according to embodiments of the present invention may include a refrigerant pipe 10 having a circular cross-section, with refrigerant flowing therethrough; and a pair of ice making plates 20 each being disposed at opposite sides of the refrigerant pipe 10, respectively, wherein the refrigerant pipe 10 is disposed between inner side surfaces of the ice making plates 20 facing each other, and each bent part thereof bent outwards is formed at a place where the refrigerant pipe is located, thus covering both sides of the refrigerant pipe by being in close contact therewith.

Generally, a refrigeration cycle is provided to implement heating, air-conditioning, and freezing by using refrigerant of which thermal characteristics and pressure characteristics change as the refrigerant is circulated through a compressor, a condenser, an expansion valve, and an evaporator in sequence.

Particularly, the refrigeration cycle in the ice maker is a kind of process producing ice by using the refrigerant of low temperature and low pressure flowing through the evaporator. Specifically, the refrigerant of high temperature and high pressure discharged from the compressor comes to have low temperature and low pressure characteristics after passing through the condenser and the expansion valve, and low temperature and low pressure refrigerant flows into the refrigerant pipe 10 of the evaporator.

At this time, a temperature of the ice making plates 20 made of thermally conductive material drops equal to or lower than freezing point of water, whereby ice is produced as the water supplied to surfaces of the ice making plates 20 is frozen. Here, a water pump is provided to supply water to the surfaces of the ice making plates 20.

An ice making process is completed as ice is produced on the surfaces of the ice making plates 20 by allowing the high temperature and high-pressure refrigerant to be bypassed directly to the refrigerant pipe 10, whereafter the ice is collected in an ice storage bin by being separated from the surfaces of the ice making plates 20. The ice maker makes the ice by repeating the process of ice making and ice separating.

Conventionally, in order to secure a maximum area for heat exchange with the ice making plate in a flat shape, a compression process was separately performed for the refrigerant pipe of which the cross-section thereof is famed to be an elliptical shape as illustrated in FIG. 2.

On the other hand, the refrigerant pipe 10 according to embodiments of the present invention is manufactured in a circular cross-section without separately performing the compression process. In order to maximally secure heat transfer efficiency, only, both inner side surfaces of the ice making plates 20 are configured to be bent such that the ice making plates 20 come into close contact with both sides of the refrigerant pipe 10, thereby performing heat exchange with the refrigerant pipe 10.

Here, as the refrigerant pipe 10 is formed with a diameter greater than a separation distance of a pair of ice making plates 20 and as the ice making plates 20 are bent outwards, the refrigerant pipe 10 having a circular cross-section is able to be inserted into a place between a pair of ice making plates 20.

Accordingly, while the efficiency in ice making and ice separating is prevented from being decreased by maximally securing a heat exchange area between the refrigerant pipe 10 and the ice making plate 20, a phenomenon that the heat exchange area is rather reduced because the refrigerant pipe 10 becomes to have hollow parts due to the compression process thereof may also be prevented from occurring.

In addition, with the refrigerant flowing inside the refrigerant pipe 10, the inside is formed at low pressure in the ice making process and at high pressure in the ice separating process. Here, when the ice maker stops, in the process to maintain an internal pressure balance of the refrigerant pipe 10, the internal pressure rises at least two times higher than the internal pressure when the ice maker is operating. As a result, the refrigerant pipe 10 swells, whereby a distortion phenomenon wherein ice making plate 20 bulbously protrudes may occur, and this may obstruct ice separating from being smoothly accomplished.

However, since the refrigerant pipe 10 according to embodiments of the present invention is provided with a circular cross-section, it can prevent the ice separating phenomenon from being obstructed by the ice making plate 20 being bulbously bent due to the swollen refrigerant pipe 10.

Meanwhile, the ice making plate 20 may be configured with a flat part 26 formed and extending on some portions excluding the rounded part 22, and a bent part 24 formed and bent to extend inclinedly inward from the flat part 26 on remaining sections excluding the rounded part 22 and the flat part 26, thereby extending to the rounded part 22.

Referring to FIGS. 3 to 4, the ice making plate 20 is composed of the flat part 26 which is an overall smooth section, the bent part 24 bent inward from the flat part 26 to maximally secure a heat exchange area between the ice making plate 20 and the refrigerant pipe 10, and the rounded part 22 being bent outwards from the bent part 24 and coming into contact with the refrigerant pipe 10, thereby exchanging heat.

That is, the ice making plate 20 is bent outwards along the refrigerant pipe 10 after being bent inward temporarily to the side of the refrigerant pipe 10. Accordingly, the heat transfer efficiency between the refrigerant pipe 10 and the ice making plate 20 is maximized, whereby ice making time, ice separating time, and energy consumed for the ice making are reduced and good quality ice can be secured.

Here, as illustrated in FIG. 4, an angle θ at which the bent part 24 is formed from the flat part 26 may be an acute angle. In addition, the bent part 24 extends to the rounded part 22.

That is, the ice making plate 20 is provided with the bent part 24 formed inward and the refrigerant pipe 10 bent outwards, whereby the heat exchange area with the refrigerant pipe 10 is enlarged, but this may act as an obstacle for smoothly separating the ice frozen on the ice making plate 20.

Accordingly, with a planiform surface of flat part 26 as a reference, by forming the angle θ at which the bent part 24 is formed to be an acute angle, and by extending the bent part 24 to the rounded part 22, the ice may be induced to naturally fall off the ice making plate 20 and to fall outwards to a lower part in the ice separating process.

Here, the ice frozen on the ice making plate 20 is provided to fall along the rounded part 22 in the ice separating process. Accordingly, in the ice separating process, the ice is provided to fall along the rounded part 22 outwards to the bottom and to be collected in the ice storage bin without interfering with other parts.

Referring to FIG. 3 again, in the evaporator for the ice maker according to embodiments of the present invention, a plurality of partitioning parts 30 compartmentalizing the outer side surface is installed on the ice making plate 20, which allows the ice producing area to be disposed along a lengthwise direction of the refrigerant pipe 10, and the bent part 24 may be formed to be separated at a regular distance from the adjacent partitioning part 30.

That is, as water is allowed to flow on the outer side surface of the ice making plate 20 and to exchange heat with the refrigerant pipe 10, the ice making process occurs, and the ice is formed the surface. In the case that the ice is designed to be formed in one sheet over the whole ice making plate 20, a time required for the ice making or the ice separating is increased, whereby ice making efficiency decreases.

Accordingly, by installing a plurality of the partitioning parts compartmentalizing the outer side surface to allow the ice producing area to be arranged widthwise, ice making efficiency can be maximized by not allowing the ice to be foamed in one sheet on the ice making plate 20, but by allowing the ice making to be implemented for the ice divided in a plurality of sections.

Here, the partitioning part 30 is not separately installed to the ice making plate 20, but may be realized by naturally forming through a press process of the ice making plate 20.

In this case, as illustrated in FIG. 4, the bent part 24 is formed between the flat part 26 and the rounded part 22 in embodiments of the present invention. In the case the bent part 24 is manufactured to extend to the partitioning part 30, heat exchange efficiency between the refrigerant pipe 10 and the ice making plate 20 may be enhanced, but manufacturing performance of the ice making plate 20 may be decreased.

That is, when a manufacturing process is established for the partitioning part 30 and the bent part 24 to be connected to each other, as a corresponding area becomes a vulnerable area in terms of endurability or potential of deformation occurrence becomes high, manufacturing efficiency decreases due to an occurrence of defects. By manufacturing the bent part 24 to be formed at a regular distance separated from the partitioning part 30, occurrence of defects or damage phenomenon in the manufacturing process can be prevented.

In the case above, at the place the bent part 24 and the partitioning part 30 are separated in embodiments of the present invention, the flat part 26 may extend to the rounded part 22. Accordingly, endurability of the ice making plate 20 can be prevented from decreasing as the flat part 26 extends directly to the rounded part 22.

Meanwhile, the flat parts 26 of the ice making plates 20 located at places parallel to each other in embodiments of the present invention may be formed to be separated at a regular distance.

Referring to FIG. 5, in order to maximize the ice making efficiency and ice separating efficiency by increasing the heat exchange area between the refrigerant pipe 10 and the ice making plate 20, minimizing the distance between a pair of ice making plates 20 may be desirable.

In embodiments of the present invention, by allowing the distance between a pair of ice making plates 20 to be separated at a regular distance, a housing or a tube may be provided to be stably as well as smoothly coupled with an upper part of a pair of the ice making plates 20.

Furthermore, end parts of the rounded parts 22 of the ice making plates 20 different from each other and located parallel to each other may be formed to be separated from each other at a regular distance.

The closest distance between a pair of the ice making plates 20 is the distance b between the end parts of the rounded parts 22. This is because the ice making efficiency and ice separating efficiency become maximized as the distance b between the end parts of the rounded parts 22 becomes shorter, whereby the heat exchange area between the refrigerant pipe 10 and the ice making plate 20 becomes greater.

When end parts of the rounded parts 22 of the ice making plates 20 different from each other at parallel locations are manufactured to come into contact, as a corresponding area becomes a vulnerable area in terms of endurability of the ice making plates 20, by forming the end parts to be separated at a regular distance, the endurability of an evaporator can be sufficiently secured.

Specifically, a distance c between the flat parts 26 of the ice making plates 20 different from each other and located at places parallel to each other is longer than the distance b between end parts of the rounded parts 22 of the ice making plates 20 different from each other, and shorter than the distance a between centers of the rounded parts 22 of the ice making plates 20 different from each other.

Here, the reason why the distance between the flat parts 26 is shorter than the distance a between the centers of the rounded part 22 is because the diameter of the refrigerant pipe 10 is longer than a distance between a pair of the ice making plates 20.

Meanwhile, the refrigerant pipe 10 is composed of a plurality of straight line parts each extending in a straight line along the lengthwise direction and disposed in parallel to a direction perpendicular to the lengthwise direction, and communicating parts communicating with end parts of the adjacent straight line parts to allow the refrigerant to flow in zigzags. In addition, the ice making plates 20 may be provided to cover the straight line parts of the refrigerant pipe 10.

In case of manufacturing the ice making plates 20 to cover the whole refrigerant pipe 10 which is in zigzags, the rounded part 22 is additionally manufactured to correspond to the communicating part which is the bent form of the refrigerant pipe 10, whereby cost and time for manufacturing the ice making plate 20 is increased.

Accordingly, in order to maximize the manufacturing efficiency, the ice making plates 20 may be manufactured to cover only the straight line parts.

Here, the rounded part 22 is configured to cover the one side or the opposite side of the straight line part of the refrigerant pipe 10 by being in close contact therewith, and a ridge 32 protruding outwards may be formed on the flat part 26 connecting a pair of the rounded parts 22 to each other.

Referring to FIGS. 3 and 5, the ridge 32 is provided to be extended widthwise on the outer side surface of the flat part 26 of the ice making plate 20 to prevent the ice from being formed in one sheet, together with the partitioning part 30, Accordingly, the ice is frozen divided into a plurality of sections by the ridges 32 and the partitioning parts 30 on the outer surface of the ice making plate 20, whereby ice making efficiency is enhanced.

The ridge 32 may be formed in a triangle shape of which the width becomes gradually narrowed as a cross-section thereof moves further outwards. Accordingly, in the ice separating process, the ice falls not only to the lower part, but also to the outside of the lower part, whereby phenomenon of colliding with or remaining on other areas of the ice making plate 20 may be prevented.

According to the evaporator for the ice maker composed of the above-described structure, by allowing the ice making plate to be bent and to exchange heat with the refrigerant pipe, it is possible not only to maintain the circular cross-section, but also to maximally secure heat exchange efficiency and ice separating efficiency of the evaporator.

In addition, as the compression process for the refrigerant pipe is omitted, heat transfer efficiency or ice separating efficiency can be prevented from decreasing due to damage phenomenon occurring in the compression process for the refrigerant pipe.

In addition, as the cross-section of the refrigerant pipe is circular-shaped, even in the case that an internal pressure of the refrigerant pipe increases steeply, heat exchange area with the ice making plates is not reduced, whereby maximum heat transfer efficiency can be secured and a refrigerant having a relatively high pressure is possible to use.

Although embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An evaporator for an ice maker, comprising:

a refrigerant pipe having a circular cross-section, with refrigerant flowing therethrough; and a pair of ice making plates disposed on opposite sides of the refrigerant pipe, wherein the refrigerant pipe is disposed between inner side surfaces of the ice making plates facing each other, wherein the ice making plates comprise:

rounded parts provided by being formed outwards at a place where the refrigerant pipe is located such that the rounded parts cover both sides of the refrigerant pipe by being in close contact therewith;

flat parts provided and extending in areas excluding the rounded parts; and bent parts provided and formed to extend inclinedly inward from the flat parts on remaining areas excluding the rounded parts and the flat parts, and extending to the rounded parts, wherein the flat parts of the ice making plates different from and located at places parallel to each other are configured to be separated at a regular distance from each other, wherein end parts of the rounded parts of the ice making plates different from and located at places parallel to each other are configured to be separated at a regular distance from each other, wherein a distance between the flat parts of the ice making plates different from and located at places parallel to each other is longer than a distance between the end parts of the rounded parts of the ice making plates different from each other, and is shorter than a distance between centers of the rounded parts of the ice making plates different from each other, and wherein a diameter of the circular cross-section of the refrigerant pipe is longer than the distance between the flat parts of the ice making plates different from and located at places parallel to each other.

2. The evaporator for the ice maker of claim 1, wherein an angle of the bent parts that are formed from the flat parts is an acute angle.

3. The evaporator for the ice maker of claim 1, wherein the bent parts extend to the rounded parts.

4. The evaporator for the ice maker of claim 1, wherein ice frozen on the ice making plates is provided to fall along the rounded parts in an ice separating process.

5. The evaporator for the ice maker of claim 1, wherein a plurality of partitioning parts are provided on the ice making plates to allow an ice producing area to be disposed along a lengthwise direction of the refrigerant pipe by compartmentalizing outer side surfaces of the ice making plates; and the bent parts are configured to be separated at a regular distance from adjacent partitioning parts.

6. The evaporator for the ice maker of claim 5, wherein, at the places the bent parts and the partitioning parts are separated, the flat parts extend to the rounded parts.

7. The evaporator for the ice maker of claim 1, wherein the refrigerant pipe is composed of:

a plurality of straight line parts each extending in a straight line along a lengthwise direction of the refrigerant pipe and disposed in parallel to a direction perpendicular to the lengthwise direction; and communicating parts communicating end parts of adjacent different straight line parts with each other to allow the refrigerant to flow in zigzags, and the ice making plates are configured to cover the straight line parts of the refrigerant pipe.

8. The evaporator for the ice maker of claim 7, wherein the rounded parts each are configured to cover the refrigerant pipe by being in close contact with both sides of the straight line parts of the refrigerant pipe, and a flat part connecting a pair of rounded parts among the flat parts is provided thereon with a ridge protruding outwards.

9. The evaporator for the ice maker of claim 8, wherein the ridge has a triangle shape wherein a width of a cross-section thereof becomes gradually narrowed as the cross-section approaches outwards.

* * * * *